United States Patent [19]

Kovar et al.

[11] 4,206,623

[45] Jun. 10, 1980

[54] METHOD OF AND APPARATUS FOR FEEDING ROD-SHAPED ELEMENTS SEQUENTIALLY IN SPACED RELATIONSHIP

[75] Inventors: Jan Kovar, Ricmanice; Jan Drkal, Brno, both of Czechoslovakia

[73] Assignee: Vyzkumny ustav tvarecich stroju a technologie tvareni, Brno, Czechoslovakia

[21] Appl. No.: 6,801

[22] Filed: Jan. 25, 1979

[51] Int. Cl.[2] ..... B21H 9/00

[52] U.S. Cl. ..... 72/108

[58] Field of Search ..... 72/108, 252, 71

[56] References Cited

U.S. PATENT DOCUMENTS

| | | | |
|---|---|---|---|
| 3,602,025 | 8/1971 | Awano et al. | 72/71 |
| 3,643,486 | 2/1972 | Hladky | 72/108 |

*Primary Examiner*—Lowell A. Larson

[57] ABSTRACT

Rods which are worked, for example, in a rolling mill by cross-wedge rolling are introduced into the mill by means of a second rod which is shifted forward for the length of the rod portion being worked, the second rod being subsequently returned through a distance exceeding an elongation of the worked rod during the rolling of the latter. The invention can be utilized for repeated feeding of rod-shaped elements, where a gap is required between the worked and the following supplied piece.

7 Claims, 9 Drawing Figures

METHOD OF AND APPARATUS FOR FEEDING ROD-SHAPED ELEMENTS SEQUENTIALLY IN SPACED RELATIONSHIP

BACKGROUND OF THE INVENTION

The invention relates to a method of and an apparatus for the introduction of rod-shaped elements into a working machine in which a gap is required between the worked piece and the following piece, the working machine, for example, being a mill for cross-wedge rolling such elements. The invention is particularly adapted for use with machines wherein the end of a rod, which has been heated as by an induction heating device through which the rod passes, is rolled between rolls of the machine.

Known feeding devices for similar purposes are either located between the heating device and the working station, or in front of the heating device. A drawback of such known feeding device is that such device works with a rod which has already been heated to a working temperature, thereby subjecting the feeding device to arduous working conditions and wearing it unduly.

A drawback of the second known arrangement is that each introduced rod has to shift a part of a second, up to now unworked rod, the first rod being worked upon being elongated in the course of its rolling and shifting the second rod backwardly. This is disadvantageous for the proper rolling of the rod being worked upon, since the rotating motion of such rod is braked, and, in addition, the rods frequently deviate from the feeding axis with consequent damage to the heating device.

SUMMARY OF THE INVENTION

The present invention has among its objects the elimination of the drawbacks of the prior art outlined above. In accordance with the invention, the rod being worked is introduced into the working station of the machine by a second rod being shifted forwardly toward the working station for a distance equal to the length of the rod being worked, the second rod then being returned in a reverse direction for a distance exceeding the prolongation of the first rod, due to its having been rolled or worked in other manners.

The feeding apparatus of the present invention, in a preferred embodiment thereof, incorporates a main pneumatic cylinder affixed to the frame of the machine, a throughgoing main piston rod with a main piston slidably supported in the main cylinder, the end of the main piston rod facing the machine being provided with a first arm with a front clamping jaw and with a second arm with a guiding screw provided with a nut cooperating with a stop fixed to the machine frame. An auxiliary pneumatic cylinder with an auxiliary piston rod is arranged on the other end of the main piston rod, the auxiliary piston rod being provided with a first auxiliary arm terminating in a rear clamping jaw and also with a second auxiliary arm with an auxiliary guiding screw provided with an auxiliary nut cooperating with a stop on the machine frame.

A safety pneumatic cylinder with a piston and a piston rod is affixed to the main pneumatic cylinder, the end of this piston rod being provided with a safety clamping jaw emcompassing the main piston rod. A main limit switch is disposed in a stop mechanism of the machine, a safety limit switch being provided on the machine frame at the nut, an auxiliary limit switch being connected to the auxiliary pneumatic cylinder near the auxiliary nut, and a control limit switch being affixed to the machine frame.

An advantage of the feeding apparatus according to the invention is that a gap is provided between the worked rod and the second, following rod which is prepared for working, such gap allowing the elongation of the first, worked rod while eliminating mutual contact of both rods in the course of the rolling or other working of the worked rod.

An exemplary method according to this invention for the introduction of rods into a cross-wedge rolling mill proceeds as follows: The rod to be worked is introduced into the working station of the rolling mill between the rolls thereof by means of another, second rod which is shifted forward for the length of the first rod portion being rolled and is returned in a reverse direction throughout a length exceeding the elongation of the first rod during its rolling, such cycle being repeated throughout the successive workings of the first rod, after which the second rod is introduced into the rolling mill, and the rolling operation upon the second rod carried out as before, yet another third rod, replacing the second rod in its feeding function after the working of a certain length of the second rod.

DESCRIPTION OF THE DRAWINGS

FIGS. *2a–2g* are simplified diagrams illustrating sequential phases of the operation of the apparatus for feeding rods in accordance with the invention.

DESCRIPTION OF THE PREFERRED EMBODIMENT

Figure 1:
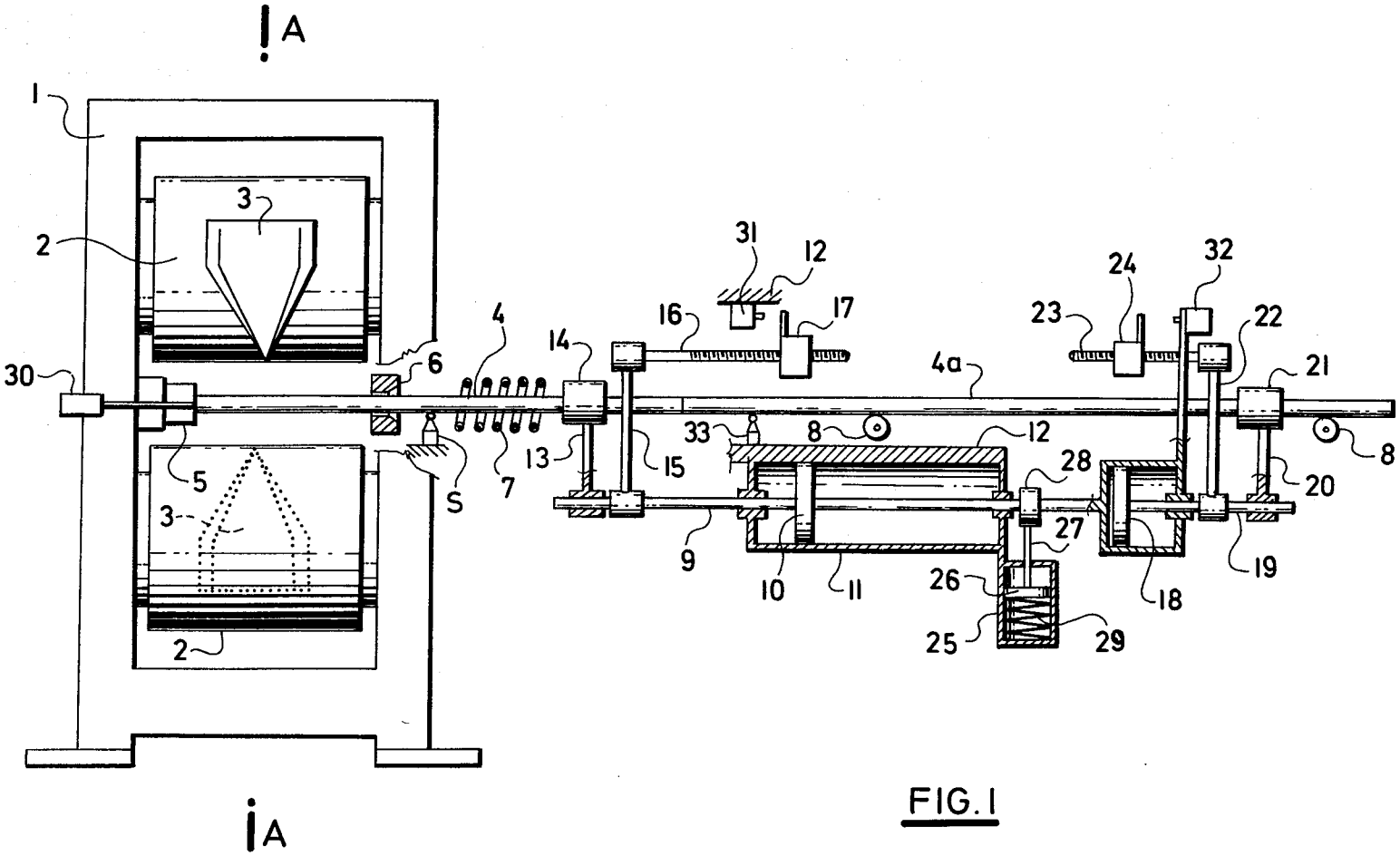
FIG. 1 is a diagrammatic view in elevation of a preferred embodiment of apparatus in accordance with the invention for feeding rods to a cross-wedge rolling mill.
Figure 2A:
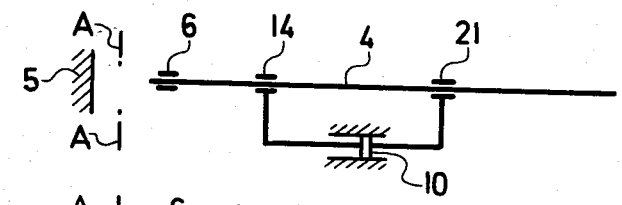
Figure 2B:
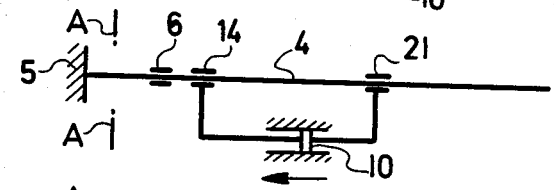
Figure 2C:
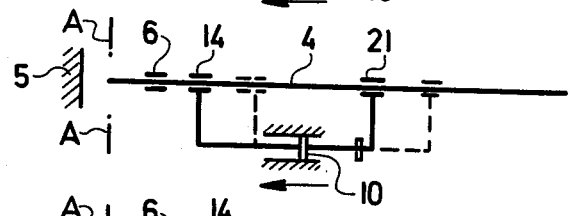
Figure 2D:
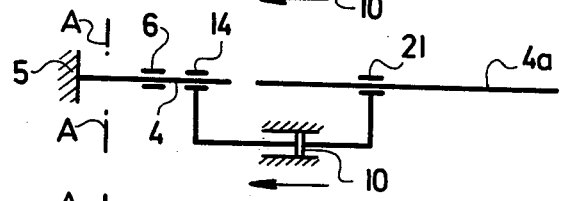
Figure 2E:
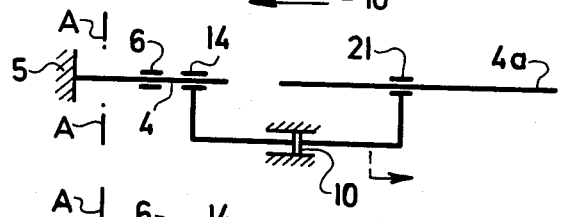
Figure 2F:
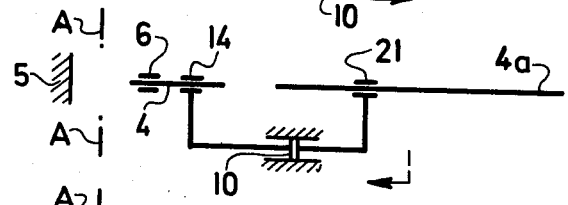
Figure 2G:
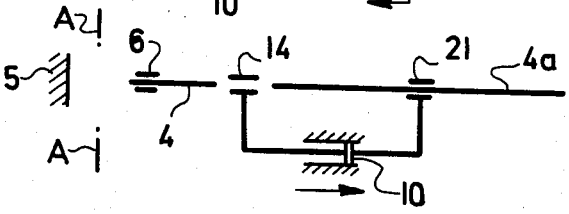

Turning first to FIG. 1, there is there shown a mill for the cross-wedge rolling of a rod. Such mill comprises a frame 1 wherein opposed parallel rolls 2 rotating in opposite directions are rotatably supported, rolls 2 being provided with opposed tools 3 for rolling the left-hand end of a rod 4, such end or rod 4 resting against a stop 5 and being guided by a guiding sleeve 6. An inductor 7 fed by a heating device (not shown) is arranged in front (to the right) of the guiding sleeve 6. A roller track to the right of the mill stand, of which only two rollers 8 are shown, feeds the rods to the mill.

The rod-feeding device proper comprises a main piston rod 9 with a main piston 10 slidably arranged in a main pneumatic cylinder 11 affixed to the frame 12 of the rolling mill. The main piston rod 9 passes through the main pneumatic cylinder 11. The left-hand end of the piston rod 9, which faces the mill stand, is provided with an arm 13 which supports a front clamping jaw 14, such end of the main piston rod also being provided with a further, longer arm 15 which supports a guiding screw 16 upon which there is threadedly mounted a nut 17.

An auxiliary pneumatic cylinder 18 provided with an auxiliary piston rod 19 is provided on its right-hand end with an auxiliary arm 20 which supports a rear clamping jaw 21. A further auxiliary arm 22 on the right-hand portion of piston rod 19 supports an auxiliary guiding screw 23 upon which there is threadedly mounted an auxiliary nut 24.

A safety pneumatic cylinder 25 with a piston 26 and a piston rod 27 supporting on its upper end a safety clamping jaw 28 encompassing the main piston rod 9 is affixed to the main pneumatic cylinder 11. A coil compression spring 29 is located in the safety pneumatic cylinder 25 below the piston 26 therein.

Figure 3:
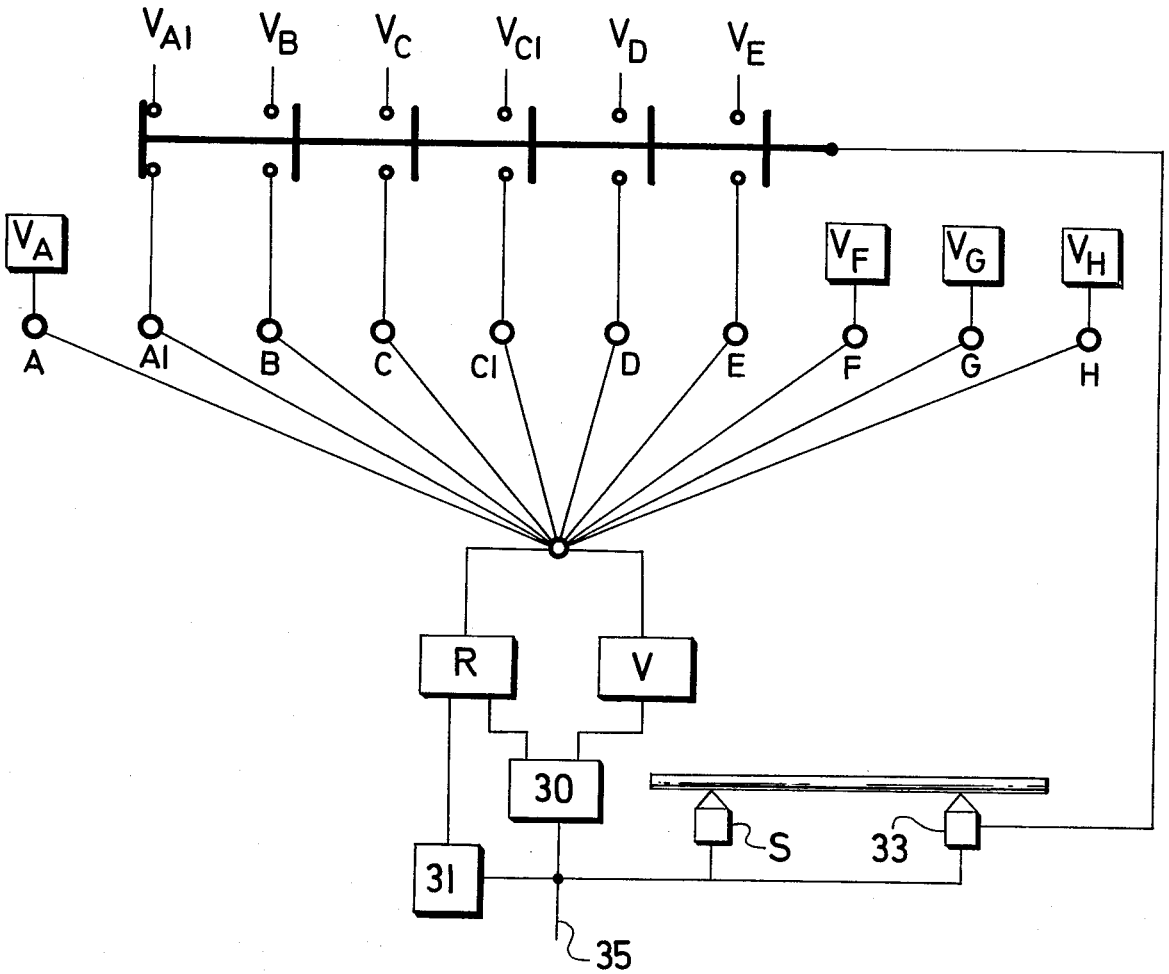
FIG. 3 is a block diagram showing the main elements of the control system for the rod-feeding apparatus of the invention.

The described rod-feeding apparatus is controlled by a main limit switch 30 disposed in the rod stopping member 5 of the rolling mill, a safety limit switch 31 affixed to the frame 12 of the mill near the nut 17, an auxiliary limit switch 32 affixed to the auxiliary pneumatic cylinder 18 near the auxiliary nut 24, a control limit switch 33 affixed to the frame 12 of the mill at the location of the extreme rear (right) position of the front clamping jaw 14, and a switch S affixed to the frame 12 of the mill forwardly (to the left) of the switch 33, as shown in FIGS. 1 and 3.

FIGS. *2a–2g*, inclusive, schematically illustrate successive phases of the operation of the rod-feeding apparatus of the invention. In FIG. *2a*, which illustrates the starting position of the feeding apparatus, the left-hand end of a rod 4 to be worked is disposed to the right of the transverse central axis A—A of the rolls of the mill. As shown in FIG. 1, such axis is disposed somewhat to the right of the rod-stopping member 5. FIG. *2b* shows the position of the parts 10, 14, and 21 of the feeding apparatus after the rod 4 has been fed to the left so that its left-hand end engages stop 5. Following the rolling of the left-hand end the rod 4, the parts 10, 14, and 21 return to the right to assume the position thereof shown in FIG. *2a*.

In the case of a too short feed stroke (caused for example by the slipping of the feeding jaws upon the rod) the feeding device first assumes its usual forward position (FIG. *2B*) due to a signal from the end switch 31 which replaces the signal from the main limit switch 30, the feeding apparatus then resuming its usual rear position (FIG. *2a*).

FIG. *2d* illustrates the position of the feeding apparatus after a normal feeding stroke and the loading of a fresh rod 4*a*. FIGS. *2e* and *2f* illustrate additional rearward and forward movement of the rear feeding jaw 21 while the front feeding jaw 14 remains stationary the rod 4*a* then returns to the left for a short distance. FIG. *2g* shows the return of the feeding device to the right following the feedins stroke thereof described above in connection with FIG. *2f*.

FIG. 3 illustrates the main elements of the control system of the feeding device. The main limit switch 30 of stop 5 is supplied with current from a source not shown through the conduit 35, the main limit switch 30 being connected to a time relay R and to switches A–H, inclusive, which are closed in sequence. The switches have the following functions: Switch A opens the front jaw 14 of the feeder, whereas switch $A_1$ opens the rear jaw 21 of the feeder. Switch B closes the safety clamping jaw 28; switch C provides for an additional rearward movement of jaw 21; switch $C_1$ provides for the opening of rear jaw 21 of the feeder. Switch D provides for an additional forward movement of rear jaw 21; switch E opens the safety clamping jaw 28; switch F provides for the rearward (to the right) motion of the feeder, switch G provides for the closing of jaws 14 and 21; and switch H provides for the feeding or forward (to the left) motion of the feeder.

The arrangement according to this invention operates as follows: After rolling and separating the rolled product from the rod 4 by conventional blades (not shown) forming parts of the tools 3 on the rolls 2, a switch (not shown) controlled by a dog on one of the rolls 2 of the rolling machine releases a signal for starting the introduction, whereby the front and rear clamping jaws 14 and 21 are closed, whereafter pressure air is admitted into the main pneumatic cylinder 11 to the rear side of the main piston 10, the main piston rod 9 of which is shifted and introduces the rod 4 between the rolls 2 up to the stop 5 (*2b*), where the rod 4 strikes the main limit switch 30, which opens the front and rear clamping jaws 14 and 21. Simultaneously, the operation of the main pneumatic cylinder 11 is changed over for a rearward motion, whereby pressure air is admitted in front of the main piston 10 and the main piston rod 9 returns together with the auxiliary pneumatic cylinder 18 into their original positions (*2a*), where they come to rest after the main piston 10 has reached the end of the main pneumatic cylinder 11. Thus the introductory cycle is finished.

As soon as the end of the worked rod 4 in the course of introduction between rolls 2 leaves the control limit switch 33, said switch 33 releases a signal for feeding another rod, 4*a* from a storage container (not shown) into the rolling axis of rollers 8 of the roller track between the front and rear clamping jaws 14 and 21. A gap remains, however, between the front end of the newly supplied rod 4*a* and the rear end of the worked rod 4.

In the described cycle, i.e., the introductory motion of the front and rear clamping jaw 14 and 21 and of the rods 4 and the rear motion of the sole clamping jaws 14 and 21 are changed in that the further supplied rod 4*a* performs an additional rear motion for a length surpassing the elongation of the worked rod 4. This additional rear motion of the further rod 4*a* is achieved in that on a signal from the main limit switch 30 the front clamping jaw 14 is opened, the rear clamping jaw 21, however, remains closed and holds a further rod 4*a*. Air is thereafter admitted into the safety pneumatic cylinder 25, which closes the safety clamping jaw 28 of the main piston rod 9. Air is thereafter admitted to the auxiliary pneumatic cylinder 18, the auxiliary piston rod 19 returns the rear clamping jaw 21 and thus also the supplied rod 4*a* for length surpassing the elongation of the worked rod 4. The extent of this rear motion of the rear clamping jaw 21 is determined by the distance of the auxiliary nut 24 from the auxiliary limit switch 32.

After termination of this rear motion the rear clamping jaw 21 is opened, air is admitted into the auxiliary pneumatic cylinder 18 (opposite end), whereby the piston rod 19 returns to its original position. The clamping of the main piston rod 9 by the safety clamping jaw 28 is thereafter released by the return spring 29 in the safety pneumatic cylinder 25, so that the main piston rod can return to a position in which the main piston 10 strikes the end face of the main pneumatic cylinder 11. Thus the cycle for introduction of a short rod 4 is finished.

If for any reason a rod 4 has not been introduced up to the stop 5, the safety limit switch 31 releases a signal for opening the front and rear clamping jaws 14 and 21. The main piston rod 9 thereafter returns into its original position. The safety limit switch 31 thereafter releases by way of a relay R (FIG. 3) a signal for a repeated clamping of the front and rear clamping jaw 14 and 21 and for the following full introduction of the rod 4 up to the stop 5.

The sequence of the individual signals and operations is determined by the control system shown in FIG. 3.

When starting a rod 4 a time relay 4 closes the switches in the sequence $A,A_1,F,G,H$ until the rod reaches the end switch 30 of stop 5. Thereby the time relay R is cut-off, and a cam V is connected which closes the same switches as the time relay R. If a rod 4 is not advanced into the stop 5 to actuate the switch 30, a switch 31 is closed mechanically and the time relay R completes the feeding. When the rod clears the switch 33, the switches $B,C,C_1,D,E$ are closed and the switch $A_1$ is opened. The feeder now first shifts the fresh rod 4*a* rearwardly and then only the switches $A_1,F,G,H$ are closed; this cycle continues until the rod 4*a* clear switch S, whereby the normal feeding function, i.e. connection sequence $A,A_1,F,G,H$ is restored.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. Apparatus for the sequential forward feeding of rod-shaped elements in axially aligned relationship into a working machine having a working station, said machine requiring a gap between the first-worked element and the next supplied, second element to be worked, comprising means for feeding the first, worked element in the direction of its axis into the working station of the machine by means of the second element, means for shifting the second element forwardly for the length of the first, worked element, and means for moving the second element rearwardly, after the forward end of the first element has reached a predetermined position in the working station of the machine, through a distance exceeding the elongation of the first, worked element due to its being worked upon by the machine.

2. Apparatus according to claim 1, wherein the means for introducing the first, worked element into the working station of the machine comprises a main, reversible power means affixed to the frame of the machine, a main rod reciprocated by the main power means parallel to the path of feeding of the lements toward the machine, a front clamping jaw affixed to the main rod near the working machine, adjustable stop means for determining the extent of reciprocation of the main rod, an auxiliary power means fixed to the main rod rearwardly of the front clamping jaw, an auxiliary rod reciprocated by the auxiliary power means in a direction parallel to the main rod, a rear clamping jaw affixed to the auxiliary rod, a second adjustable stop means for determining the extent of reciprocation of the auxiliary rod and the rear clamping jaw, the auxiliary rod and the rear clamping jaw affixed thereto being operable independent of the main rod and the front clamping jaw and constituting means for moving the second element rearwardly after the forward end of the first element has reached a predetermined position in the working station of the machine, and means for supporting the introduced elements in the course of their being fed to the machine.

3. Apparatus according to claim 2, wherein the main reversible power means comprises a fluid-receiving cylinder, and the main rod is a piston rod bearing a piston slidable within said main cylinder, and the auxiliary power means comprises an auxiliary fluid cylinder fixed to the main piston rod, and the auxiliary rod is a piston rod having an auxiliary piston secured thereto and slidable within the auxiliary cylinder.

4. Apparatus according to claim 3, comprises an arm supporting the guiding screw affixed to the end of the main piston rod facing the working machine, a fixed nut, said guiding screw threadedly engaging such nut, an auxiliary guiding screw affixed to the auxiliary piston rod, an auxiliary nut, the auxiliary screw being threadedly engaged with the auxiliary nut.

5. Apparatus according to claim 3, comprising a safety pneumatic cylinder affixed to the main pneumatic cylinder, a piston and a piston rod slidably supported in the safety pneumatic cylinder, and a safety clamping jaw supported upon the piston rod of the safety pneumatic cylinder, said safety clamping jaw encompassing the main piston rod.

6. Apparatus as claimed in claim 3, comprising a stop for the worked shaped element in the working machine, a main limit switch provided in such stop, a safety limit switch affixed to the frame of the machine close to the nut of the guiding screw, and auxiliary limit switch affixed to the auxiliary pneumatic cylinder, and a control limit switch affixed to the frame of the machine.

7. A method for the sequential introduction of rod-shaped elements in axially aligned relationship forwardly into a working machine having a working station wherein a gap is required between the first, worked element and the next supplied, second element to be worked, said method comprising introducing the first, worked element into the working station of the machine by means of a second element, shifting the second element forwardly for the length of the first, worked element, and thereafter moving the second element rearwardly through a distance exceeding the elongation of the first, worked element due to its being worked upon by the machine.

* * * * *